US005469959A

United States Patent [19]

Gummer

[11] Patent Number: 5,469,959

[45] Date of Patent: Nov. 28, 1995

[54] HOSIERY DISPLAY PACKAGE

[75] Inventor: Raymond J. E. Gummer, Grafton, Wis.

[73] Assignee: Wigwam Mills, Inc., Sheboygan, Wis.

[21] Appl. No.: 248,395

[22] Filed: May 24, 1994

[51] Int. Cl.[6] ..... B65D 85/18

[52] U.S. Cl. ..... 206/299; 223/87

[58] Field of Search ..... 206/299, 292; 229/164; 223/87

[56] References Cited

U.S. PATENT DOCUMENTS

| | | | |
|---|---|---|---|
| D. 264,185 | 5/1982 | Roberts . | |
| 1,651,172 | 11/1927 | Youngblood . | |
| 2,816,653 | 12/1957 | Jacobi . | |
| 2,855,649 | 10/1958 | Kanter | 206/299 X |
| 3,329,386 | 7/1967 | Rosen . | |
| 3,415,359 | 12/1968 | Vrana . | |
| 3,997,091 | 12/1976 | Burnette | 223/87 X |
| 4,014,436 | 3/2977 | Tunis . | |
| 4,132,309 | 1/1979 | Shaylor . | |
| 4,257,552 | 3/1981 | Thorneburg . | |
| 4,601,417 | 7/1986 | Kunreuther | 206/292 X |
| 4,967,952 | 11/1990 | Roessiger | 229/87.19 |

FOREIGN PATENT DOCUMENTS

| | | | |
|---|---|---|---|
| 2399365 | 4/1979 | France | 223/87 |

*Primary Examiner*—Allan N. Shoap
*Assistant Examiner*—Christopher J. McDonald
*Attorney, Agent, or Firm*—Bell, Seltzer, Park & Gibson

[57] ABSTRACT

There is provided a package for hosiery, such as pairs of socks, for display on the pins of a point-of-purchase display rack so that the lower end portion and upper end portion are visible below the support band. The package includes a hanger support member and an integral hosiery support band formed integrally with the hanger support band. The hanger support band has a pressure sensitive adhesive on at least a portion of the interior of the support band.

14 Claims, 1 Drawing Sheet

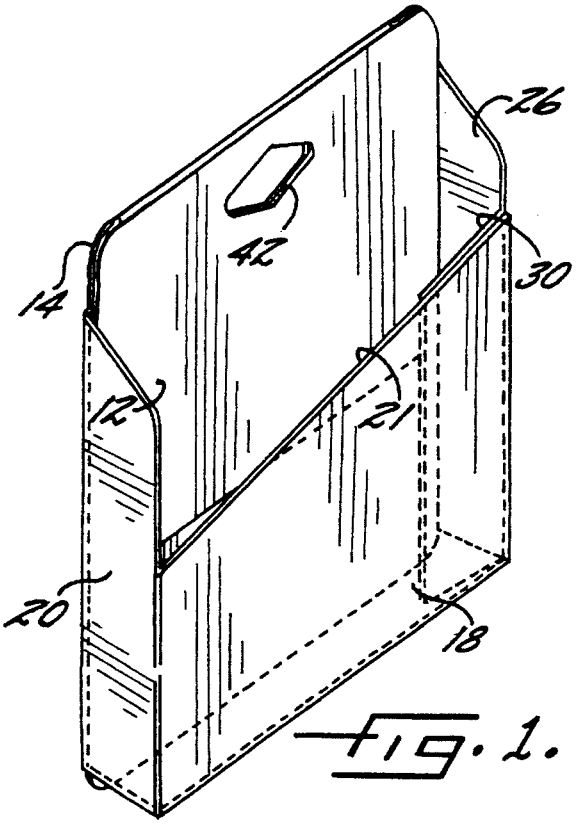
Fig. 1.
Fig. 2.
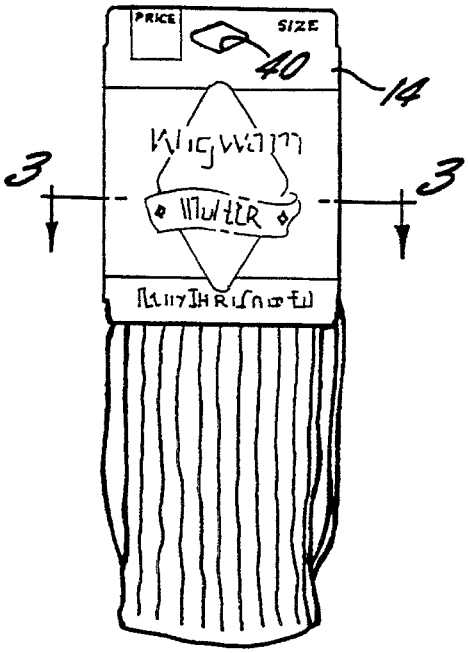
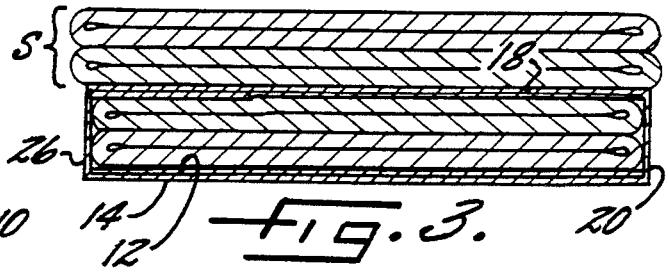
Fig. 3.
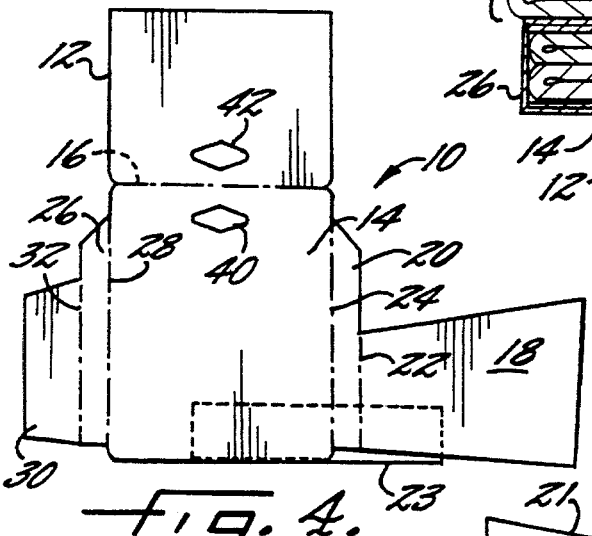
Fig. 4.
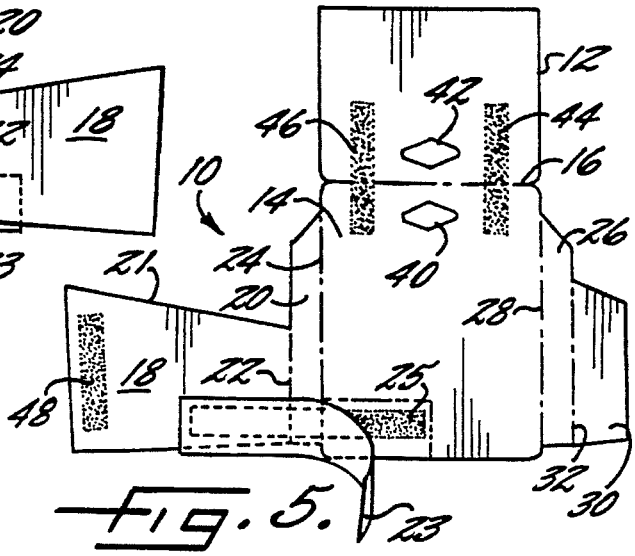
Fig. 5.

HOSIERY DISPLAY PACKAGE

BACKGROUND OF THE INVENTION (1) Field of the Invention

This invention relates generally to a hosiery display package, especially for socks. More particularly, this invention is directed to a package formed of paperboard which is adapted to support a pair of hosiery for display on a pin-type merchandising rack.

(2) Description of the Prior Art

Hosiery display packages from paperboard have been used for many years. For example, disclosed in Rosen U.S. Pat. No. 3,329,386 is a display hanger for socks which includes a pin-type hanger and a sock encircling band portion in which the front panel has interlocking flaps to support the socks and a portion of the sock overlays the band.

Another type of hosiery package is described in Shaylor U.S. Pat. No. 4,132,309, which discloses a package hanger having a sock encircling band in which a portion of the sock overlays the front panel. This patent discloses a sock package formed from a single paperboard blank with the inside of the blank having a pressure sensitive adhesive coating over the entire sock encircling band. The paperboard blank is folded with a pair of socks within the band portion so that the outboard side panels fold around the socks with the pressure sensitive adhesive in physical contact with the socks to adhesively support the sock in the package. This package does not allow for easy removal of a pair of socks because the pressure sensitive adhesive surrounds the entire encircling band.

In another example of a display package, U.S. Pat. No. 4,257,522, there is disclosed a hosiery display package which includes a support band encircling the median portion of a pair of socks. The socks are maintained with the support band through the resilient forces resulting from contact of the panels of the support band and the socks. In addition, other means of displaying socks have included using a plastic heel gore hook having a pin-type hanger support loop and a separate band around the socks displaying indicia. Many types of display hangers also must use a plastic dart to maintain the socks together as a pair.

SUMMARY OF THE INVENTION

It is therefore an object of the present invention to provide a single piece paperboard blank formed to maintain a pair of hosiery within a hosiery band for displaying the hosiery on point-of-purchase displays.

Another object of this invention is to provide a hosiery display package having means for retaining a matched pair of hosiery in a substantially vertical position, prominently displaying product identification and advertising and suspending the package on the pin element of a pin-type point-of-purchase display.

A further object of the present invention is to provide a display package for a pair of hosiery, such as a pair of socks, which eliminates the use of plastic darts on crew length and longer socks to insure that each sock stays together as a pair.

Yet another object of the present invention is providing a method for packaging hosiery including a package which has a pressure sensitive adhesive on a portion of the interior of a hosiery encircling portion, removing a release strip covering the adhesive area, placing a pair of hosiery within the band, and retaining the hosiery in individual packages.

These and other objects are accomplished by the present invention in which there is provided a hanger display package which includes a hanger support and an integral support band which encircles a pair of flattened hosiery and maintains the hosiery in the package with the upper and lower end portions of the hosiery being visible below the support band for viewing by perspective buyers.

The hosiery display package of the present invention is formed from a single die cut blank, preferably paperboard, which is scored for folding so that the entire outer surface of the display package is formed by one side of the blank. It is thus possible to use a paperboard which is calendared and coated on one side to form a surface suitable for printing graphics and product information such as to identify the type of hosiery contained therein. Because of the calendared and coated paperboard, attractive advertising and product information can be printed on all outwardly facing surfaces of the display package. The display package is provided in different sizes to support various types and sizes of socks.

The hosiery display package is formed from a paperboard blank having a hanger support member including a front panel and a hanger panel adapted to be folded so as to overlie a portion of the front panel and provide a double-thickness hanger support with suitable hanger means, such as an opening or a hook-like cutout, provided at the upper end for supporting the package on an outwardly extending pin of a point-of-purchase display rack. The hanger support member is of substantially the same width as a flattened pair of hosiery of the type which is adapted to be supported by the package.

A hosiery support band is formed by folding the horizontal legs of the paperboard blank at the respective score lines of each panel to provide a front panel integral with and extending downwardly from the hanger support panel, a rear panel of substantially the same width as the front panel, and a pair of side panels connecting opposed side edges of the front and rear panels to maintain the front and rear in parallel spaced apart relationship. The side panels are about the same width as the width of the flattened unfolded pair of hosiery so that the support band encircles the medial portion of the pair of flattened hosiery with the lower end portions and upper end portions of the hosiery being visible below the support band. An upper edge of the rear panel is oriented to slope downwardly from one side panel to the other side panel to position the hosiery vertically when being displayed. A portion of the interior of the support band is coated with a pressure sensitive adhesive that extends about one-half of the circumference of the band and has placed thereover a strip of release paper. The empty display packages may be shipped in a flattened condition to the hosiery plant where the hosiery is placed within the display package.

To insert the hosiery in the display hanger package, the opposite side panels are firmly grasped in one hand and the release strip removed with the other hand exposing the pressure sensitive adhesive portion. The hosiery is then simply slipped through the encircling support band and the opposite side panels are then released so that the interior of the support band with exposed pressure sensitive adhesive engages a portion of the pair of hosiery. A portion of the hosiery is then folded over the upper edge of rear panel.

BRIEF DESCRIPTION OF THE DRAWINGS

Other objects, features and advantages of the present invention will become apparent from the following detailed description taken in conjunction with the accompanying drawings in which:

FIG. 1 is an isomeric rear view of the hosiery display hanger of the present invention in assembled condition;

FIG. 2 is a similar view to FIG. 1 but illustrating a front view of the hosiery display package supporting a folded and flattened pair of hosiery therein;

FIG. 3 is an enlarged horizontal sectional view taken substantially along lines 3—3 in FIG. 2 and illustrating the manner in which the support band encircles and engages the socks held therein;

FIG. 4 is an elevated view of one side of the paperboard blank which is adapted to form the outer surface of the hanger package of the present invention; and FIG. 5 is a view similar to FIG. 4 but illustrating the inner side surface of the paperboard blank of the present invention.

DETAILED DESCRIPTION OF PREFERRED EMBODIMENTS

Referring first to FIGS. 4 and 5, there is shown the single piece blank employed to form the hosiery display package of the present invention in which the blank is generally designated by 10. The blank forms a hanger support member and a hosiery support band.

The hanger support member formed from blank 10 includes a pair of rectangular hanger support panels, referred to as first hanger support panel, which is integrally joined with the front panel 14 and a second hanger support panel 12, which are joined along horizontal score line 16. The upper end portion of front panel 14 is provided with suitable means for supporting the package on an outwardly extending pin of a point-of-purchase display rack, shown as hole 40. A hole 42 is provided in the upper end of hanger panel 12 so that it mates with hole 40 when front hanger panel 12 is folded along score line 16 to overlie the front panel 14. Areas of adhesive, indicated at 44 and 46, are provided on at least one of the inner surfaces of the panels 12 and 14 as shown more clearly in FIG. 5.

The horizontal leg of the blank 10 is adapted to form the hosiery support band and includes the lower portion of front panel 14. A rear panel 18 of substantially the same width as the front panel 14 but of a different vertical length is connected thereto by a side panel 20 at score lines 22, 24. A second side panel 26 is connected to front panel 14 by score line 28. In a preferred embodiment a relatively narrow overlap panel 30 is connected to side panel 26 along the vertical score line 32 to complete the hosiery support band. An area of adhesive 48 is provided on the inner surface of panel 18 for attaching the same to panel 30. As seen in FIG. 1, upper edge 21 of rear panel 18 is oriented to slope downwardly from side panel 26 to side panel 20. The downward slope is angled to position the hosiery vertically when being displayed as shown in FIG. 2 and corresponds to the angular orientation of the fold at the heel gore of the hosiery when the folder hosiery are disposed vertically. Where tubular type hosiery are to be packaged, i.e., hosiery without a heel portion, the upper edge 21 of rear panel 18 is substantially horizontal. The angle may, depending upon the type of hosiery displayed extend at an angle of up to about 30°. The upper edge of overlap panel 30 is similarly-angled so that when rear panel 18 and overlap panel 30 are glued together a smooth upper edge 21 is formed.

An area of pressure sensitive adhesive 25 is applied approximately halfway around the circumference of the support band and protected until use by release paper 23. The pressure-sensitive adhesive is placed on the lowermost inside parts of front panel 14, rear panel 18 and one of the side panels. The interior portion of the hosiery encircling band that is covered by the pressure sensitive adhesive only need be sufficient in size so that when it adheres to the hosiery it covers a sufficient area to maintain the hosiery in a substantially vertical position therein. After the adhesive is applied, a release strip is applied over the adhesives.

In a preferred method of manufacture, the blank is prepared on a suitable die cutting apparatus to cut and score a strip into a plurality of blanks 10 and the waste material is removed. The blank is made of paperboard, plastic or the like. The blank is printed either before or after the die cutting operation.

To form the hosiery display package shown in FIG. 1 from the blank 10 shown in FIGS. 4 and 5, the hanger panel 12 is folded along the common score line 16 downwardly over front panel 14 so that the adhesive areas 44, 46 contact the panels and maintain the same in overlying relationship to provide a two layer double thickness hanger support member with the holes 40, 42 aligned so that the package may be supported from a pin on a pin-type point-of-purchase display. The side panels 20, 26 and rear panel 18 are folded along respective score lines 24, 28 and 22, while overlap panel 30 is folded along score line 32. Overlap panel 30 is attached to panel 18 by adhesive 48 to form the hosiery support band.

As indicated in FIG. 2, various types of identification information and advertising matter is printed on one side of the blank and this side of the blank may be calendared and/or provided with a glossy or laminated coating. Since only the side of the blank which is to form the outer surface of the package has the more expensive finish, the cost of producing the blanks is reduced and the outer surface of the package is more attractive and more soil resistant than the inner surface. As has been mentioned, the dimensions of the panels making up the support band are correlated with the width and thickness of the type of hosiery to be displayed therein and supported thereby. The dimensions of the panels 14, 18, 20 and 26 are such that the support band encircles and maintains the medial portion of the hosiery in substantially a vertical position therein with the upper and lower end portions of the hosiery being visible below the support band.

To insert the pair of hosiery in the display hanger package, the opposite side panels 20, 26 are firmly gripped in one hand and the release strip 23 removed with the other hand exposing the pressure sensitive adhesive portion 25. The hosiery, e.g., a pair of flattened socks S is then slipped into the encircling band where one portion of the socks mildly engages the exposed pressure sensitive adhesive 25. The upper portion of the pair of socks is then folded or draped over the upper edge 21 of rear panel 18, as shown in FIG. 3, with one end portion of said pair of hosiery extending downwardly through said support band and the other end portion extending downwardly over the outside surface of said rear panel. It should be understood that other methods of inserting hosiery into the encircling band may be used.

When the blanks are assembled to form the hosiery display hanger package, as illustrated in FIG. 1, the support band, formed by panels 14, 18, 20 and 26, may be flattened so that a large number of the display packages can be shipped in a relatively small space. Also the entire outer surface of the display package is formed from one side of the blank, the side illustrated in FIG. 4, so that it is only necessary to provide an expensive finish on one side of the blank. All outwardly facing surfaces of the package can be provided with suitable advertising and/or other identifying indicia while it is necessary to imprint only one side of the blank.

While the present invention has been described in connection with the exemplary embodiments thereof, it will be understood that any modifications will be apparent to those of ordinary skill in the art and that this application is intended to cover any adaptations or variations thereof. Therefore, it is manifestly intended that this invention be only limited by the claims and equivalents thereof.

Which is claimed is:

1. A display package for supporting a pair of hosiery for display on a point-of-purchase hanger rack made from a blank comprising:

a hanger support member for supporting said package on said display rack; and a hosiery support band integrally formed with said hanger support member for encircling and retaining said hosiery therein, said hosiery support band including a front panel of predetermined width, a rear panel having an upper edge, said rear panel being substantially the same width as the front panel, and a pair of side panels of predetermined width connecting opposite side edges of said front and rear panels to maintain said front and rear panels in parallel spaced apart relationship; and a pressure sensitive adhesive applied to the interior of about one-half of the whole portion of said front panel, said rear panel and a connecting side panel of said hosiery support band, said adhesive having a release strip attached thereto.

2. The display package according to claim 1 wherein said hanger support member includes a first hanger support panel which is integrally joined to said front panel, and a second hanger support panel of substantially the same width and which overlies said first hanger support panel.

3. The display package according to claim 2 wherein said hanger support panels are joined along a common score line.

4. The display package according to claim 3 wherein said hanger support panels are adhesively connected together.

5. The display package according to claim 1 wherein said upper edge of said rear panel of said hosiery support band is downwardly angularly oriented.

6. The display package according to claim 1 wherein said display package is formed from a blank comprising a single piece of paperboard.

7. The display package according to claim 6 wherein the side of said paperboard blank which becomes the outside when the package is formed, is calendared, coated and contains indicia.

8. In combination, a pair of hosiery and a display package supporting said hosiery for display on a point-of-purchase hanger rack, said display package comprising:

a hanger support member including a pair of hanger support panels having upper and lower ends with means associated therewith at its upper end for supporting said package on said display rack; and a hosiery support band integrally formed with said lower end of said hanger support member, said hosiery support band including a front panel of at least substantially the same width as said hosiery, a rear panel having an upper edge, said rear panel being substantially the same width as the front panel having an upper edge, and a pair of side panels connecting opposite side edges of said front and rear panels to maintain said front and rear panels in parallel spaced apart relationship of substantially the same width as the thickness as said hosiery, said pair of hosiery being disposed so as to drape over said upper edge of said rear panel with one end portion of said pair of hosiery extending downwardly through said support band and the other end portion extending downwardly over the outside surface of said rear panel, and pressure sensitive adhesive applied to the interior of about one-half of the whole portion of said front panel, said rear panel and a connecting side panel whereby said adhesive holds the median portion of said hosiery in place within said encircling band whereby the lower end portion and the upper end portion of said hosiery are visible below said support band.

9. The combination according to claim 8 wherein said hanger support member includes said front panel and a hanger support panel of substantially the same width.

10. The combination according to claim 9 wherein said hanger support panels are joined along a common score line.

11. The combination according to claim 10 wherein said hanger support panels are adhesively connected together.

12. The combination according to claim 8 wherein said upper edge of said rear panel of said hosiery support band is downwardly angularly oriented so that said two end portions of said pair of hosiery are supported so as to vertically overlie each other.

13. The combination according to claim 8 wherein said display package is formed from a blank comprising a single piece of paperboard.

14. The combination according to claim 13 wherein the side of said paperboard blank which becomes the outside when the package is formed, is calendared, coated and contains indicia.

* * * * *

UNITED STATES PATENT AND TRADEMARK OFFICE

CERTIFICATE OF CORRECTION

PATENT NO. : 5,469,959

DATED : November 28, 1995

INVENTOR(S) : Raymond J.E. Gummer

It is certified that error appears in the above-indentified patent and that said Letters Patent is hereby corrected as shown below:

On the cover page, Col. 2, line 2, "3/2977" should be -- 3/1977 --.

On the cover page, Col. 2, line 4, the References, "4,257,552" should be -- 4,257,522 --.

Abstract, line 7; Col. 1, lines 24, 28, 31, 64; Col. 2, lines 47, 55, 58; Col. 3, line 65; Col. 4, lines 5, 48, 51; Col. 5, line 27, and Col. 6, line 22 change "pressure sensitive" to -- pressure-sensitive --.

Column 2, line 7, "perspective" should be -- prospective --.

Column 2, lines 12 and 15, "calendared" should be -- calendered --.

Column 2, line 61, before "rear" insert -- the --.

Column 3, line 2, "isomeric" should be -- isometric --.

Column 3, line 58, "folder" should be -- folded --.

Column 4, line 21, "two layer" should be -- two-layer --.

Column 4, line 32, "calendared" should be -- calendered --.

UNITED STATES PATENT AND TRADEMARK OFFICE

CERTIFICATE OF CORRECTION

PATENT NO. : 5,469,959

DATED : November 28, 1995

INVENTOR(S) : Raymond J.E. Gummer

It is certified that error appears in the above-indentified patent and that said Letters Patent is hereby corrected as shown below:

Column 5, line 50, "calendared" should be -- calendered --.

Column 6, line 47, after "blank" insert -- , -- (a comma).

Column 6, line 48, "calendared" should be -- calendered --.

Column 5, line 17, delete "and".

Column 5, line 49, after "blank" insert -- , -- (a comma).

Signed and Sealed this

Second Day of July, 1996

*Attest:*

*Attesting Officer*

BRUCE LEHMAN

*Commissioner of Patents and Trademarks*